US005394779A

United States Patent [19]

Meeks

[11] Patent Number: 5,394,779

[45] **Date of Patent: * Mar. 7, 1995**

[54] BLADDER FOR SLOTTER HEAD ASSEMBLY HAVING PNEUMATICALLY LOCKED SLOTTER BLADES

[75] Inventor: William R. Meeks, Lawrence, Kans.

[73] Assignee: Lawrence Paper Company, Lawrence, Kans.

[ * ] Notice: The portion of the term of this patent subsequent to Dec. 29, 2009 has been disclaimed.

[21] Appl. No.: 165,467

[22] Filed: Dec. 13, 1993

[51] Int. Cl.[6] ..... B26D 7/26

[52] U.S. Cl. ..... 83/332; 83/676; 83/698.51

[58] Field of Search ..... 83/332, 665, 676, 678, 83/698.41, 698.51, 698.61, 699.51, 699.61; 493/368, 370, 471, 475

[56] References Cited

U.S. PATENT DOCUMENTS

| | | | |
|---|---|---|---|
| 3,008,366 | 11/1961 | Taylor Jr. | 83/698.41 X |
| 3,073,198 | 1/1963 | Clem | 83/665 X |
| 3,985,066 | 10/1976 | Kern | 83/332 X |
| 4,162,643 | 7/1979 | Coburn | 83/699.61 X |
| 5,107,737 | 4/1992 | Tagliaferri | 83/665 |
| 5,174,184 | 12/1992 | Meeks | 83/332 |
| 5,282,409 | 2/1994 | Rojas | 83/698.51 X |

*Primary Examiner*—Eugenia Jones

*Attorney, Agent, or Firm*—Hovey, Williams, Timmons & Collins

[57] ABSTRACT

Improved bladders (174–178) having a cross-sectional U-shape are provided for a rotatable slotter head assembly (120) of the type used in the slotting of box blanks is provided which includes mechanism (128) permitting rapid and easy alteration of the circumferential position of the cutting knives (126) carried by the assembly (120). Preferably, the assembly (120) includes a rotatable body (124) provided with an elongated, peripheral, knife-receiving slot (168) defined by fixed backing plates (158 ) and laterally shiftable locking plates (188). The selectively inflatable resilient bladders (174–178) are carried by the head assembly (120) and, when inflated, shift the associated movable locking plates (188) against the cutting knives (126), thereby firmly locking the latter in place. When knife adjustment is desired, one or more of the appropriate bladders (174–178) are deflated, the knives (126) are shifted as desired, and the bladders (174–178) are reinflated.

11 Claims, 2 Drawing Sheets

6.
6.
184
179
183
181
174
182
185a
180
230a
137
124
229
138
139
230
134
142
136
144
161
164
141
172
172
126
170
185
230a
124
134
131
174
137
182
136
230
144
200
181
185
204
229
142
138
139
198
126
160
188
162
166
202
158
184
183
179
174
185
181

BLADDER FOR SLOTTER HEAD ASSEMBLY HAVING PNEUMATICALLY LOCKED SLOTTER BLADES

BACKGROUND OF THE INVENTION

The present invention is broadly concerned with an improved slotter head assembly of the type used in box-making equipment for forming flap-defining slots in box blanks. More particularly, it is concerned with such a slotter head assembly which is improved by provision of a uniquely shaped, pressurized, fluid-actuated bladder mechanism which is received by and cooperates with a head recess having an internal surface cross-sectional shape closely resembling that of the outer bladder surface. The improved bladder mechanism cooperates with the head assembly for selectively locking the slotter blade knives in position, while permitting ready adjustment of the knife positions. In this fashion, the box blank slotting equipment can be readily altered to produce blanks of different configurations without the need for time-consuming manual knife adjustments. In preferred forms, the pressurized, fluid-actuated mechanism includes an elongated, pneumatic bladder positioned adjacent the corresponding knife blades and operable upon pressurizing the bladder to engage and lock the knives in place.

The manufacture of box blanks on an industrial scale normally involves slotting and creasing of precut corrugated sections in order to create a blank having the requisite fold lines and flaps for a given box. Normally, the slotting equipment used for this purpose includes an elongated shaft carrying a plurality of annular, rotatable slotter heads. Normally, a pair of slotting knives are secured to each head for rotation therewith. The circumferential spacing of the slotter knives thus determines the depth of the flap-defining slots for a given blank.

A persistent problem in the box-making industry stems from -the time and effort required to change the position of slotting knives on the individual slotting heads. That is to say, after a given box blank run is completed, it is often necessary to change the circumferential location of the knives in order to produce in the next run blanks of different configuration. Generally speaking, prior art slotter heads are equipped with a series of threaded bores, in the sidewall thereof, for attachment of the slotted knives by means of bolts. When it is necessary to change the location of one or more of the knives, it is necessary to remove the knife-retaining bolts, relocate the knife to a desired position, and reinstall the bolts. This practice can be relatively time-consuming, especially when it is considered that a number of heads need to be changed for each run. Moreover, the slotter heads are located within large blank-forming equipment, and it is sometimes difficult to gain access to the heads for knife changeover.

U.S. Pat. No. 5,174,184 (incorporated by reference herein) describes a slotter head assembly having pneumatically-locked slotter blades especially designed to allow for quick knife adjustment without the need for removing and reinstalling bolts or other mechanical fasteners. In the '184 patent, quick knife adjustment of the knife assembly is provided by means of a head presenting a knife-receiving slot in the periphery thereof, with one or more knives being adjustably positioned within the slot. Structure is provided for releasably locking the knives within the slot, including a pressurized fluid-actuated bladder mechanism adjacent a slot for selectively engaging and locking the knives in place.

In the preferred form disclosed in the '184 patent, the head is in the form of an annular, rotatable body having an elongated slot in the periphery thereof, permitting placement of one or more knives at any one of a number of positions around the slot. The knife-locking mechanism advantageously includes structure defining a fluid-receiving cavity and means for permitting selective filling of the cavity with pressurized fluid and for selectively draining pressurized fluid therefrom. Filling the cavity creates a locking action on the knives, while fluid drainage releases the knives. One or more elongated, pneumatic bladders formed of resilient synthetic material are provided within the rotatable head and conventional valve means is coupled with each bladder to permit selective inflation thereof with pressurized air, or, alternatively, deflation thereof. One or more shiftable plates are provided adjacent the bladders and are moveable laterally to a limited degree in response to filling or draining of the bladders. The shiftable plates are oriented for engaging the knives so that, upon inflation of the appropriate bladders, the corresponding knives are rigidly locked in place along the knife-receiving slot of the head. When it is desired to change the knife position, it is only necessary to partially or completely deflate the corresponding bladders, whereupon the knives can be manually moved to the next position and re-locked by re-inflation of the bladders.

In experimental practice with the apparatus described in the '184 patent, it has been determined that the elongated, pneumatic bladders may initially undergo radial expansion into the bladder recess excess void spaces in locations non-adjacent to the shiftable plates before locking action is imposed on the knives. Under such circumstances, the result may be that undesirable higher fluid pressure in the bladder is necessary to effect knife-locking action. Higher pressures in the bladder is undesirable because it either leads to a higher incidence of bladder failure for a given material of construction or requires that bladders be fabricated from more costly materials.

Accordingly, there is a real and unsatisfied need in the art for a simplified slotter head and knife arrangement which incorporates a pneumatic bladder assembly that achieves knife-locking action with a lower fluid pressure.

SUMMARY OF THE INVENTION

The present invention overcomes the problems outlined above, and provides a pneumatic bladder assembly in the form of a bladder and head recess having a half-round, cross-sectional shape. A head recess is adapted to receive the bladder so that the half-round portion of the bladder is in registry with the recess inner wall.

Broadly speaking, an article of the present invention is of a type which includes the knife assembly such as that disclosed in U.S. Pat. No. 5,174,184 as previously described. A description of the apparatus disclosed in the '184 patent appears above and will not be repeated here for the sake of brevity. The '184 patent, however, can be consulted for additional necessary details.

The bladder when received in the recesses is adapted so that there is only a small, generally uniform clearance between the outer lateral surface and the recess interior sidewall when the bladder is in its non-pressurized, deflated condition. The clearance between the bladder outer surface and recess sidewall is only large enough to permit movement of knives when the bladder is depressurized. The bladder assembly of the instant invention eliminates excess void space between the bladder and recess sidewall into which the bladder would otherwise expand when it is pressurized. As a result, the bladder /f the instant invention is capable of engaging and locking a knife in place within the head at pressures lower than would be required if excess void spaces existed between the bladder surface and recess sidewall.

DETAILED DESCRIPTION OF THE PREFERRED EMBODIMENT

Figure 1:
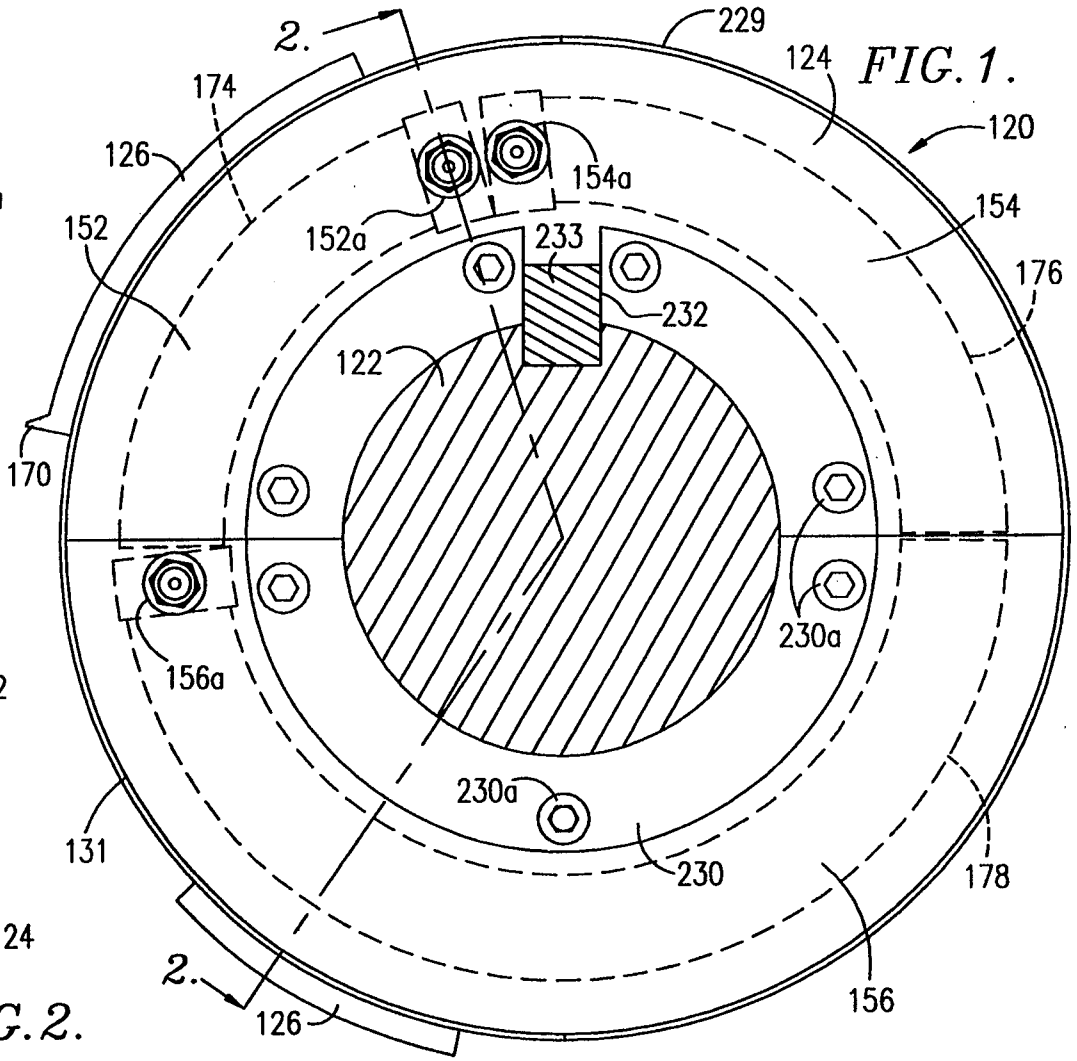
FIG. 1 is the side view of a slotter head in accordance with the invention, with the improved bladder of the assembly being shown in phantom.
Figure 2:
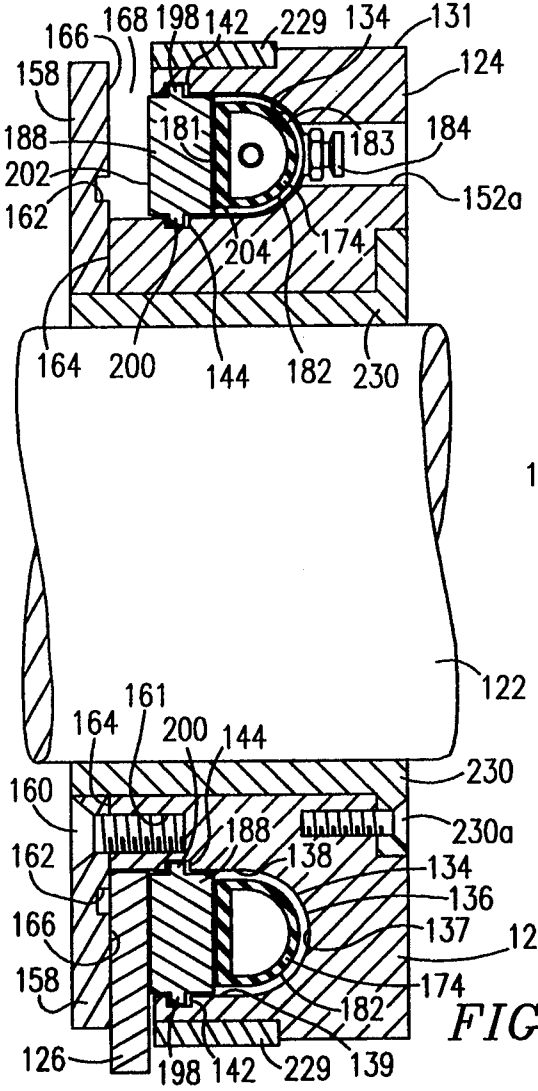
FIG. 2 is a sectional view taken along the line 2—2 of FIG. 1 and illustrating the head bladders in their relaxed positions, permitting circumferential adjustment of the knives.
Figures 3, 4, 5, 6, 7, 8:
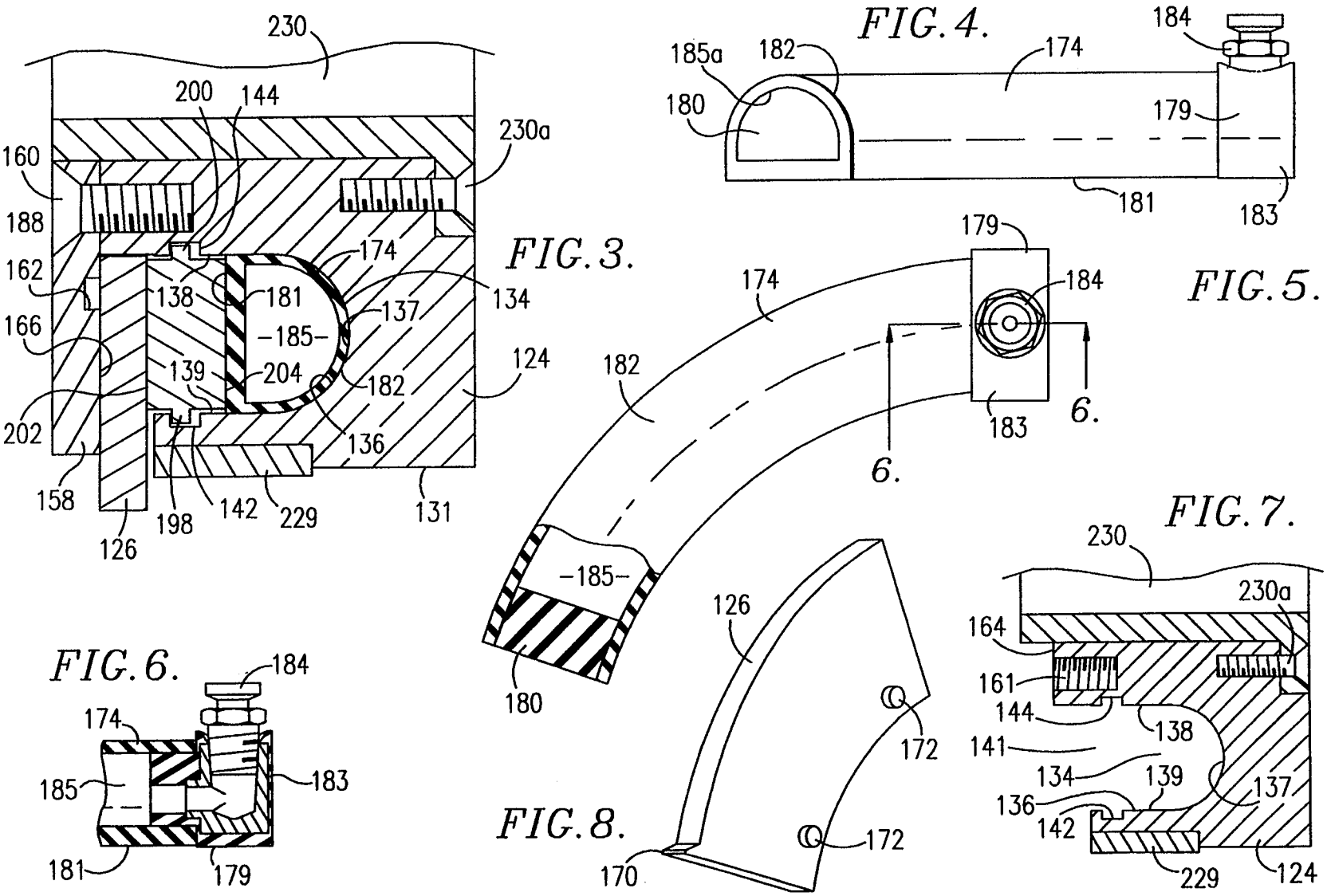
FIG. 3 is an enlarged, sectional fragmentary view illustrating the head bladder in an inflated, operative position serving to lock a knife blade in place.
FIG. 4 is an enlarged, side elevational view of the improved bladder of the present invention.
FIG. 5 is a partial fragmentary, cross-sectional, enlarged top view of the improved bladder.
FIG. 6 is a partial fragmentary, cross-sectional view of the bladder inflation/deflation valve taken along the line 6—6 of FIG. 5.
FIG. 7 is a fragmentary, cross-sectional view of the improved head showing the head recess lateral opening.
FIG. 8 is a perspective view of a knife-retaining tip adjacent the inner surface thereof.

Turning now to the drawings, and particularly FIGS. 1–3, a slotter head assembly 120 is illustrated, as it would appear when mounted upon a rotatable shaft 122. The overall apparatus is of the type described in U.S. Pat. No. 5,174,184 (incorporated by reference), which can be consulted for all necessary details. The head assembly 120 includes an annular main body 124, at least one knife 126 carried by the body 124, and mechanism broadly referred to by the numeral 128 carried by the body 124 and operable for selectively engaging and locking the knives 126 in place.

The radially outermost section of body 124 includes an elongated, continuous recess 134 which extends circumferentially about the main body and presents an internal sidewall 136, which is preferentially generally U-shaped in cross-section, as shown in FIG. 7. Sidewall section 136 includes a center portion 137, and opposite inboard and outboard wall portions 138, 139. Recess 134 thus presents an elongated, continuous lateral opening 141 as shown in FIG. 7. It will further be observed that the walls 138, 139 are provided with short, radially and circumferentially extending keeper slots 142, 144, just inboard of the lateral opening 141.

The outer peripheral surface 131 includes a series of scale markings (not shown), the purpose of which will be described.

Referring to FIG. 1, recess 134 has an elongated bladder-receiving zone 152, as well as longer bladder-receiving zones 154 and 156. Each bladder-receiving zone 152–156 is provided with an inflation/deflation valve access aperture **152*a*–156*a*, as shown in FIGS. 1 and 2, which extends through center portion 137 of recess 134 and laterally through body 124**.

A total of four arcuate, apertured, stationary backing plates 158, each extending essentially 90° about the circumference of body 124, are affixed to the latter, as best shown in FIG. 2, by means of bolts 160 extending into threaded bores 161 in the body. Each backing plate 158 includes an arcuate knife-retaining slot 162 on the inner face thereof. Furthermore, the backing plates 158 abut a shoulder region 164 of main body 124, thereby defining between the inner surfaces 166 of the backing plates 158, and the opposed recess-defining structure, a continuous knife-receiving slot 168 extending circumferentially about the periphery of main body 124.

In the illustrated embodiment, a pair of cutting knives 126 are provided. One of the knives includes a tip 170 as is conventional in equipment of this type, and is in practice normally positioned at the zero or reference point of the head and not thereafter moved. The remaining knife 126 is normally shifted circumferentially relative to the tip knife in order to alter the length of slots cut using the head. The knives 126 are themselves conventional, except that they are each provided with elongated, integral, outwardly extending retaining pins 172 (as shown in FIG. 8) adapted to be received within the knife retaining slots 162 of the backing plates 158.

The locking mechanism 128 associated with head assembly 120 includes a total of three improved, elongated pneumatic bladders 174, 176, and 178 in accordance with the present invention. As illustrated, the bladder 174 is located within zone 152 and is relatively short. On the other hand, bladder 176 is located within zone 154 and extends approximately 120° about the circumference of the head. Finally, bladder 178 is located within zone 156 and extends a full 180° about the head.

Each of the bladders 174–178 is similarly configured, differing from one another only in axial length. Thus, for the sake of brevity, only bladder 174 will be described in detail, it being understood that bladders 176 and 178 include substantially identical structure and operate in substantially the same way.

Referring to FIGS. 4 and 5, bladder 174 is preferentially made from a resilient, synthetic resin or rubber-like material and is U-shaped in a cross-section, having first and second opposite ends 179, 180. Bladder 174 presents a locking plate engaging face 181 and a U-shaped outer surface 182 extending continuously between the first and second ends 179, 180. An enlarged, solid, U-shaped bladder portion 183 is associated with first end 179 and includes a conventional inflation/deflation valve 184 extending outwardly therefrom, as shown in FIGS. 4 and 5. Valve 184 is adapted to communicate with inner fluid cavity 185. Fluid cavity 185 extends generally uniformly between first and second ends 179, 180 and includes inner cavity surface **185*a* which is also U-shaped in a cross-section. Fluid cavity 185** is adapted to selectively receive, contain, and release fluid under pressure.

Bladder 174 is received within recess 134 associated with zone 152, with valve 184 extending through recess center portion 137 and partially through valve access aperture **152*a*, as shown in FIG. 2. Enlarged portion 183 is snugly received by and in registry with a corresponding portion of recess sidewall 136. As shown in FIG. 2, bladder 174 is sized so that there is only a small, generally uniform clearance between outer bladder surface 182 and recess sidewall 136 when bladder 174 is in its non-pressurized, deflated condition. It will be appreciated that the clearance between sidewall 136 and outer bladder surface 182 is only large enough to permit movement of knives 126, as later described in detail, when the bladder is depressurized. It will be further appreciated that there is no excess void space between recess sidewall 136 and outer bladder surface 182 into which bladder 174 will first expand before bladder 174 can exert sufficient force to lock knives 126** in place. Such excess void spaces would, for example, exist between a bladder with a round outer surface positioned within a recess having a square interior surface in a cross-sectional view.

U-shaped bladder outer surface 182 is adapted to undergo only slight and generally uniform radial expansion such that the small clearance between surface 182 and sidewall 136 is completely eliminated. Thereafter, exertion of higher pressure within the bladder 174 results in the movement of locking plate engaging face 181 in an outward, lateral direction.

The mechanism 128 further includes a total of six laterally shiftable knife-locking plates 188 which are located within the lateral opening 141 and cooperatively fill the latter, being placed in end-to-end adjacency for this purpose. Referring to FIG. 2, each of the locking plates 188 is arcuate in configuration and includes outer and inner projections 198, 200 respectively situated within the keeper slots 142, 144. In this fashion, the individual locking plates 188 can move laterally within the opening 141 to a limited degree. Each locking plate 188 also presents a substantially planar knife-engaging surface 202, as well as an opposed, inner, arcuate bladder-engaging surface 204 adapted to be in abutting relationship with locking plate engaging face 181 of bladder 174, as well as with corresponding faces of bladders 176 and 178.

Head assembly 120 of the present invention differs from that shown in the '184 patent in that assembly 120 is also provided with an outer wear ring 229 and an inner wear ring 230, both preferentially fabricated from a metal such as hardened steel. Inner wear ring 230 is annular in configuration and has an innermost keyway 232 adapted to receive a locking key 233 associated with shaft 122. As best seen in FIG. 2, inner wear ring 230 is slidably received by shaft 122 and is disposed between body 124 and shaft 122. Wear ring 230 is secured to body 124 by means of conventional threaded fasteners 230*a*. Outer wear ring 229 is disposed on and fastened by conventional threaded fasteners (not shown) to the outer peripheral surface 131 presented by body 124. Inner and outer wear rings 230, 229 are positioned at principal wear surfaces and are adapted to be fabricated at low cost; thus, reducing wear upon and the need to replace body 124 which is more costly to fabricate. Rotational motion associated with shaft 122, thus, is transmitted from shaft 122 through key 233, keyway 232 of inner wear ring 230, to body 124.

The use and operation of assembly 120 will next be described. It will be assumed that the knives 126 forming a part of the head assembly are properly positioned for a given blank-forming run. Specifically, the tip knife is properly located at the zero or reference point of the head, and bladders 174–178 are fully inflated. Likewise, the shiftable blade is positioned as desired using head markings (not shown). As previously discussed, the operational characteristics of bladders 174–178 are identical, and thus only the operation of bladder 174 will be discussed.

When bladder 174 is pressurized by means of passing pressurized air through valve 184, outer surface 182 immediately expands radially into the small clearance between outer surface 182 and sidewall 136 and face 181 moves laterally into abutment with inner bladder engaging surface 204. It will be understood by one skilled in the art that when such clearances are eliminated between sidewall 136 and bladder surface 182, continued pressurization of bladder 174 results in the application of force by bladder 174, through locking plate 188 upon knife 126, to engage and lock the latter in place.

Experience has shown that use of the improved bladder 174 of the instant invention in the head assembly 120 requires a cavity pressure less than that required by the bladder disclosed in U.S. Pat. No. 5,174,184 to effect the selective engaging and locking of knives. It will be appreciated that such lower pressure requirements are afforded by the unique bladder design of the instant invention, i.e., because of the close correspondence between the general U-shape of bladder 174 and the U-shape of recess 134, which reduces excess void space between these elements. With such excess void spaces eliminated, bladder 174 of the instant invention avoids unnecessary and undesired radial expansion, and results in a more effective locking operation at lower bladder pressures. It is to be appreciated that the bladder of the instant invention also undergoes less undesirable axial expansion within bladder zones 152–156.

At the end of the blank run, if it is desired to alter the position of the movable blade 126, it is only necessary to deflate bladder 174 through the use of valve 184, until the bladder assumes the relaxed position illustrated in FIG. 2. At that point it is a simple matter to manually shift the movable blade along the periphery of the head assembly while the blade is retained within the slot 168. Complete removal of the blade at this time is prevented, inasmuch as the blade pins 172 are located within the slots 162 of the backing plates 158. Once the movable blade has been positioned to a new desired position, the bladder 178 is re-inflated with pressurized air, again using the valve 184. It will be appreciated that inflation of the bladder 174 serves to laterally shift the associated locking plates 188 rightwardly as viewed in FIG. 3, so that the appropriate blade-engaging surfaces 202 thereof firmly contact the movable knife and press it against the adjacent backing plate 158. This serves to firmly lock the knife 126 in place.

Of course, in the event that it is desired to shift the movable knife 126 to a location adjacent the bladder 174, the latter would be deflated to permit such movement, and then re-inflated.

As indicated previously, in normal practice, the tip knife 126 would not be moved inasmuch as it defines the zero or reference position for the head assembly 120. Nevertheless, if movement of this knife is desired, such would be effected in a manner described above.

The knives 126 are retained within the slot 168 during high speed rotation of head assembly 120, even in the event that one or more of the bladders unintentionally deflates. This retention is afforded by means of the knife pins 172 and the complemental receiving slots 162 of the backing plates 158. Of course, use of this retention structure requires that the backing plates 158 be removed when it is desired to completely disassemble the head assembly 120 and remove the knives 126 therefrom. However, this need be done only periodically, and therefore does not present a significant drawback.

I claim:

1. A knife assembly, comprising:

a head presenting a periphery and having a knife-receiving slot in said periphery, a knife positioned within said slot, and locking means for releasably locking said knife in said slot, said locking means including a pressurized fluid-actuated mechanism adjacent said slot for selectively engaging said knife and locking said knife in said slot, said mechanism including structure defining a recess, said recess presenting an internal sidewall having a lateral opening therethrough;

said mechanism including structure defining a fluid-receiving cavity, said cavity presenting an external surface and a locking surface, means for selectively pressurizing said cavity with fluid and for selectively depressurizing, said cavity structure receivable by said recess so that said external surface is in registry with said recess sidewall when said cavity is depressurized, said locking surface adapted to apply force in the direction of said lateral opening when said cavity is pressurized; and shiftable means for engaging said knife in response to the application of force by said locking surface.

2. The assembly of claim 1, wherein: said recess internal sidewall and said cavity external surface having cross-sectional U-shape.

3. The assembly of claim 1, said cavity-defining structure comprising:

an elongated bladder formed of resilient material, said bladder presenting said external surface and said locking surface, said external surface and said recess internal sidewall being U-shaped.

4. The assembly of claim 1, said head being rotatable, said peripheral slot permitting the placement of the knife at any one of a number of positions along the length of the slot.

5. The assembly of claim 1, including retaining means for preventing removal of said blade from said slot in the event of unintended depressurization of said cavity.

6. The assembly of claim 1, including a pair /f spaced apart knives within said slot, there being an individual, selectively operable pressurized fluid-actuatable mechanism for each of said blades, respectively.

7. A rotatable slotter head, comprising:

a rotatable body including a pair of opposed, arcuate plates adjacent the periphery of the body cooperatively defining therebetween an elongated, knive-receiving slot adjacent to said periphery, one of said plates presenting a pair of opposed side faces and being mounted for limited travel thereof toward and away from the opposed plate;

an elongated pneumatic bladder presenting an outer surface and a plate-engaging surface, said bladder carried within a recess of said body, said recess presenting an interior sidewall in registry with said bladder outer surface, said recess located for engagement with the side face of said one plate remote from said opposed plate; and means for selectively pressurizing said bladder with fluid for movement of said one plate towards said opposed plate in response to radial movement of said plate-engaging surface in order to engage and lock a knife, and for permitting selective depressurization of said bladder for releasing said knife.

8. The head of claim 7 including means for retaining said knife within said slot in the event of unintended deflation of said bladder.

9. The head of claim 7, said bladder outer surface and said recess sidewall having cross-sectional U-shape.

10. The head of claim 7, said bladder presenting a pair of closed ends, there being rigid wall means carried by said body adjacent each of said bladder ends for inhibiting axial expansion of the bladder upon inflation thereof.

11. A knife assembly, comprising:

an elongated, axially rotatable shaft;

an annular head presenting a periphery and a pair of opposed, laterally spaced apart walls extending inwardly from said periphery and cooperatively defining a knife-receiving slot therebetween, a recess associated with said head and adjacent a wall side of one of said walls opposite said slot;

said head mounted on said shaft for rotation of the head and said slot-defining walls with the shaft at all times;

an arcuate knife having a length substantially less than the length of said knife-receiving slot and position within the slot;

means for releasably locking said knife within said slot, including at least one elongated bladder having an outer surface and a knife-locking surface presented between opposite bladder ends, said bladder outer surface receivable by and registrable within said recess, said bladder having structure for selective and alternate placement of the bladder in either a pressurized or depressurized condition; and knife-engaging means operably coupled with said bladder for engaging said knife when said bladder is in one of said conditions for locking the knife in place in a desired position within said slot, and for releasing said knife when said bladder is in the other of said conditions for permitting shifting movement of the knife within and along the length of said slot and relative to both said shaft and both of said slot-defining walls, in order to change the relative position of the knife within said slot without shaft rotation and independently of the rotational position of the shaft.

* * * * *